US006244909B1

(12) United States Patent
Okada et al.

(10) Patent No.: US 6,244,909 B1
(45) Date of Patent: Jun. 12, 2001

(54) METAL TERMINAL AND BOARD-MOUNTED-TYPE CONNECTOR

(75) Inventors: Hajime Okada; Eiji Kojima, both of Yokkaichi; Koichi Shirouzu, Toyota, all of (JP)

(73) Assignees: Sumitomo Wiring Systems, Ltd., Mie; Toyota Jidosha Kabushiki Kaisha, Toyota, both of (JP)

( * ) Notice: Subject to any disclaimer, the term of this patent is extended or adjusted under 35 U.S.C. 154(b) by 0 days.

(21) Appl. No.: 09/432,404

(22) Filed: Nov. 2, 1999

(30) Foreign Application Priority Data

Nov. 5, 1998 (JP) ..... 10-315052

(51) Int. Cl.[7] ..... H01R 13/187
(52) U.S. Cl. ..... 439/844
(58) Field of Search ..... 439/844, 246, 439/247, 248

(56) References Cited

U.S. PATENT DOCUMENTS 3,784,955 * 1/1974 Reynolds et al. ..... 339/17 R
4,738,631 * 4/1988 Takahashi et al. ..... 439/248
5,713,745 * 2/1998 Sakurai et al. ..... 439/78
5,775,950 * 7/1998 Tsuji ..... 439/637
6,135,823 * 10/2000 Torii ..... 439/686

FOREIGN PATENT DOCUMENTS 8-203591 8/1996 (JP) .

* cited by examiner

*Primary Examiner*—Gary F. Paumen
*Assistant Examiner*—PhuongChi Nguyen
(74) *Attorney, Agent, or Firm*—Oliff & Berridge, PLC

(57) ABSTRACT

A board-mounted-type connector 1 includes a housing body 3, metal terminals 2 mounted in the housing body 3, and a retainer 4 mounted on the lower side of the housing body 3 to hold the metal terminal 2 against withdrawal. The metal terminal 2 has connecting ports 5A and 5B formed respectively at its upper end lower ends. The board-mounted-type connector 1 is mounted on a board 12, and in this condition each mating metal terminal 7 can be connected to the associated metal terminal 2 through a terminal-loosely-fitting hole 30, formed in the board 12, from that side of the board 12 facing away from the board-mounted-connector 1.

6 Claims, 15 Drawing Sheets

METAL TERMINAL AND BOARD-MOUNTED-TYPE CONNECTOR

BACKGROUND OF THE INVENTION

This invention relates to a metal terminal and a connector for mounting on a board which connector employs such metal terminals.

The Unexamined Japanese Patent Application Publication No. Hei 8-203591 discloses a board-mounted-type connector 100 shown in FIGS. 18 to 21. This board-mounted-type connector 100 comprises a housing 110, metal terminals 120A and 120B, and a retainer 130.

The large-size metal terminal 120A includes a fitting portion 121A for receiving a mating male metal terminal (not shown), and a board-mounting portion 123A. The board-mounting portion 123A has a resilient flexing portion 122A of a V-shape, and this portion is resiliently deformable so as to prevent an excessive stress from developing in the other portion of the metal terminal 120A. The board-mounting portion 123A is adapted to be inserted into a mounting hole H formed through a board P. The small-size metal terminal 120B also includes a fitting portion 121B, a resilient flexing portion 122B and a board-mounting portion 123B which achieve similar functions as described above for the large-size metal terminal.

Large-size cavities 111A for respectively receiving the large-size metal terminals 120A are formed in opposite (right and left in FIG. 18) end portions of the housing 110, and a plurality of small-size cavities 111B for respectively receiving the small-size metal terminals 120B are also formed in the housing, and are arranged between the opposite-end large-size cavities 111A. Fitting holes 113A and 113B for respectively passing the mating male metal terminals therethrough are formed in an upper surface (FIG. 18) (hereinafter referred to as "fitting surface 112"), and communicate respectively with the cavities 111A and 111B, the fitting holes 113A and 113B being open to the outer surface (i.e., the fitting surface). The cavities 111A and 111B are open to a mounting surface 114 facing away from the fitting surface 112, and the retainer 130 is mounted on this mounting surface 114. Engagement portions 118 each having an engagement hole 118A are formed on and project from side marginal portions of the mounting surface 114 of the housing 110. The engagement holes 118A are engageable respectively with engagement projections 139A formed on the retainer 130, and the housing 110 and the retainer 130 are held in an interconnected condition by this engagement. Bosses 119 are formed on the opposite ends of the housing 110, respectively, and these bosses 119 are fitted respectively in boss holes 141, formed in the retainer 130, when the housing 110 is connected to the retainer 130. A screw hole 119A is formed through each boss 119, and can be aligned with a corresponding screw hole (not shown) in the board P, and a screw (not shown) can pass through this screw hole 119A so as to fixedly secure the board-mounted-type connector 100 to the board P.

The retainer 130 conforms in configuration to the mounting surface 114 of the housing 110, and has receiving chambers 133A and 133B which can be aligned with the cavities 111A and 111B, respectively. When the retainer 130 and the housing 110 are connected together, the resilient flexing portions 122A and 122B are received respectively in the receiving chambers 133A and 133B in such a manner that each resilient flexing portion 122A, 122B is sufficiently spaced from the peripheral surface of the receiving chamber 133A, 133B that it can be resiliently deformed. The receiving chambers 133A and 133B have positioning holes 136A and 136B, respectively, which are open to that surface of the retainer 130 to be abutted against the board P. The engagement projections 139A, engageable respectively in the engagement holes 118A in the housing 110, are formed on the side surfaces of the retainer 130. Plate-like portions 140 extend respectively from the opposite ends of the retainer 130, and have the boss holes 141, respectively, into which the bosses 119 on the housing 110 can be fitted, respectively.

For assembling the board-mounted-type connector 100, the housing 110 is disposed with its mounting surface 114 directed upwardly, and the metal terminals 120A and 120B are disposed with their fitting portions 121A and 121B directed downwardly, and then are caused to drop respectively into the cavities 111A and 111B by their own weight.

After the metal terminals 120A and 120B are thus inserted respectively into the cavities 111A and 111B, the retainer 130 is connected to the housing 110. When the engagement projections 139A are engaged respectively in the engagement holes 118A of the engagement portions 118, the retainer 130 is locked to the housing 110 against disengagement. At this time, the bosses 119 on the housing 110 are fitted respectively into the boss holes 141 in the retainer 130.

In this assembled condition of the board-mounted-type connector 100, the board-mounting portions 123A and 123B, projecting from the retainer 130, pass respectively through the positioning holes 136A and 136B, and therefore are properly positioned as shown in FIG. 20.

For mounting the board-mounted-type connector 100 on the board P, the board-mounted-type connector 100 is disposed with the board-mounting portions 123A and 123B opposed to the board P, and the screw holes 119A are aligned respectively with the screw holes (not shown) in the board P, and the board-mounted-type connector 100 is fixedly secured to the board P by screws (not shown).

After the board-mounting portions 123A and 123B are thus fitted respectively in the mounting holes H, the board-mounting portions 123A and 123B are fixedly secured to the board P by soldering Q (see FIG. 21).

In the condition shown in FIG. 21, a mating connector (not shown), having the mating male metal terminals (not shown) mounted therein, is fitted relative to the board-mounted-type connector 100 from the upper side. When the two connectors are fitted together, the distance between the mutually-connected portions of each mating pair of metal terminals and the board P is equal to the distance (hereinafter referred to as "distance R") between the fitting surface 112 and the upper surface of the board P. This distance R is generally equal to the overall length of the metal terminals 120A and 120B.

When the two connectors, after fitted together, are vibrated independently of each other (for example, if these connectors are mounted on an automobile, such a situation can be encountered depending on the type of vibration of the automobile), a force, acting on those portions of the two metal terminals in contact with each other, is received by the soldered portion Q. A moment, acting on the soldered portion Q, is proportional to the distance R, and in the conventional construction, this distance R is inevitably equal to the overall length of the metal terminals 120A and 120B, and as a result the large moment acts on the soldered portion Q.

In the conventional construction, since the distance between the board P and the mutually-connected portions of the two metal terminals is equal to-the distance R, and therefore a large moment can inevitably act on the soldered portion Q, depending on the type of vibration.

The board-mounted-type connector 100 is mounted on the board P, and then is fitted relative to the mating connector, and in this condition, when the two connectors are energized, heat is often generated at part of the board P with the lapse of time. When part of the board P generates heat, the board P thermally expands according to the distribution of the heat. As a result, a force, tending to bring the board-mounting portions 123A and 123B out of alignment with the respective mounting holes H, acts on the soldered portions Q.

SUMMARY OF THE INVENTION

This invention has been made in view of the above problems, and an object of the invention is to provide a construction in which after board-fixing portions of metal terminals, mounted in a connector to be mounted on a board, are fixed respectively to mounting holes in the board, a force, acting on these fixing portions, is eliminated.

The above problems have been solved by a metal terminal of the invention of aspect 1 which can be received in a board-mounted-type connector to be mounted on a board; CHARACTERIZED in that the metal terminal includes a connecting portion for electrical connection to a mating metal terminal, and a board-fixing portion which is connected at one end thereof to the connecting portion, and has the other end portion defining a board-fixing portion for insertion into a mounting hole formed in the board; and the board-fixing portion is offset laterally from a side surface of the connecting portion, so that the board-fixing portion overlaps the connecting portion by a predetermined amount in a direction of a length of the connecting portion.

In the invention of aspect 2 according to aspect 1, the connecting portion is of such a construction that the mating metal terminal can be connected to the connecting portion from that side of the board facing away from the board-mounted-type connector.

In the invention of aspect 3 according to aspect 1 or aspect 2, the connecting portion is of such a construction that the mating metal terminal can be connected to the connecting portion through either of the opposite ends of the connecting portion spaced from each other in a direction of the length of the metal terminal.

According to the invention of aspect 4, there is provided a board-mounted-type connector for receiving metal terminals, as defined in any one of aspects 1 to 3, therein; CHARACTERIZED in that the board-mounted-type connector comprises an upper housing, and a lower housing for mounting on the upper housing; and a through hole for passing the board-fixing portions of the metal terminals therethrough is formed through the lower housing, and is offset from axes of the connecting portions of the metal terminals.

In the invention of aspect 5 according to aspect 4, each mating metal terminal can be connected to that end of the associated connecting portion opposed to the board, and the lower housing has connection portions, and the board has connection portions, and each of the connection portions of the lower housing and each of the connection portions of the board are aligned with that end of the associated connecting portion opposed to the board so as to enable the mating metal terminal to be connected to the connecting portion.

In the invention of aspect 6 according to aspect 4 or aspect 5, the through hole is in the form of a slot, and extends generally in the same direction as a direction of thermal expansion of the board.

In the invention of aspect 1, the connecting portion and the board-fixing portion overlaps each other by the predetermined amount in the direction of the length of the connecting portion, and therefore the overall length of the metal terminal can be reduced. Therefore, the height of the board-mounted-type connector, which receives the metal terminals therein, can be reduced.

In the invention of aspect 2, each mating metal terminal is connected to the connecting portion from that side of the board facing away from the board-mounted-type connector. Therefore, the board and the mating metal terminals vibrate generally in the same manner, and each pair of metal terminals, connected together, are less liable to be displaced with respect to each other. Therefore, the fixed portion, fixing the board-fixing portion to the board, is less liable to undergo a force tending to destroy this fixed portion.

In the invention of aspect 3, the mating metal terminal can be connected to the metal terminal through either of the opposite ends of the connecting portion spaced from each other in the direction of the length of the metal terminal, and therefore the desired connecting direction can be selected.

In the invention of aspect 4, the overall height of the board-mounted-type connector can be reduced, and therefore even when there is exerted a force tending to displace the pair of metal terminals, connected together, with respect to each other, the fixed portion, fixing the board-fixing portion to the board, is prevented from being destroyed since the distance between the board-fixing portion and the force-applied point is reduced.

In the invention of aspect 5, each mating metal terminal is connected to the metal terminal from that side of the board facing away from the board-mounted-type connector. Therefore, the board and the mating metal terminals vibrate generally in the same manner, and each pair of metal terminals are less liable to be displaced with respect to each other. Therefore, the fixed portion, fixing the board-fixing portion to the board, is less liable to undergo a force tending to destroy this fixed portion.

In the invention of aspect 6, the through hole is in the form of a slot, and extends generally in the direction coinciding with the direction of thermal expansion of the board. Therefore, when the board is thermally expanded, the board-fixing portions are allowed to displace along the through hole, thereby preventing an undue force from acting on the fixed portions each fixing the board-fixing portion to the board.

DETAILED DESCRIPTION OF THE PREFERRED EMBODIMENTS

A preferred embodiment of the present invention will now be described in detail with reference to FIGS. 1 to 17.

Figure 1:
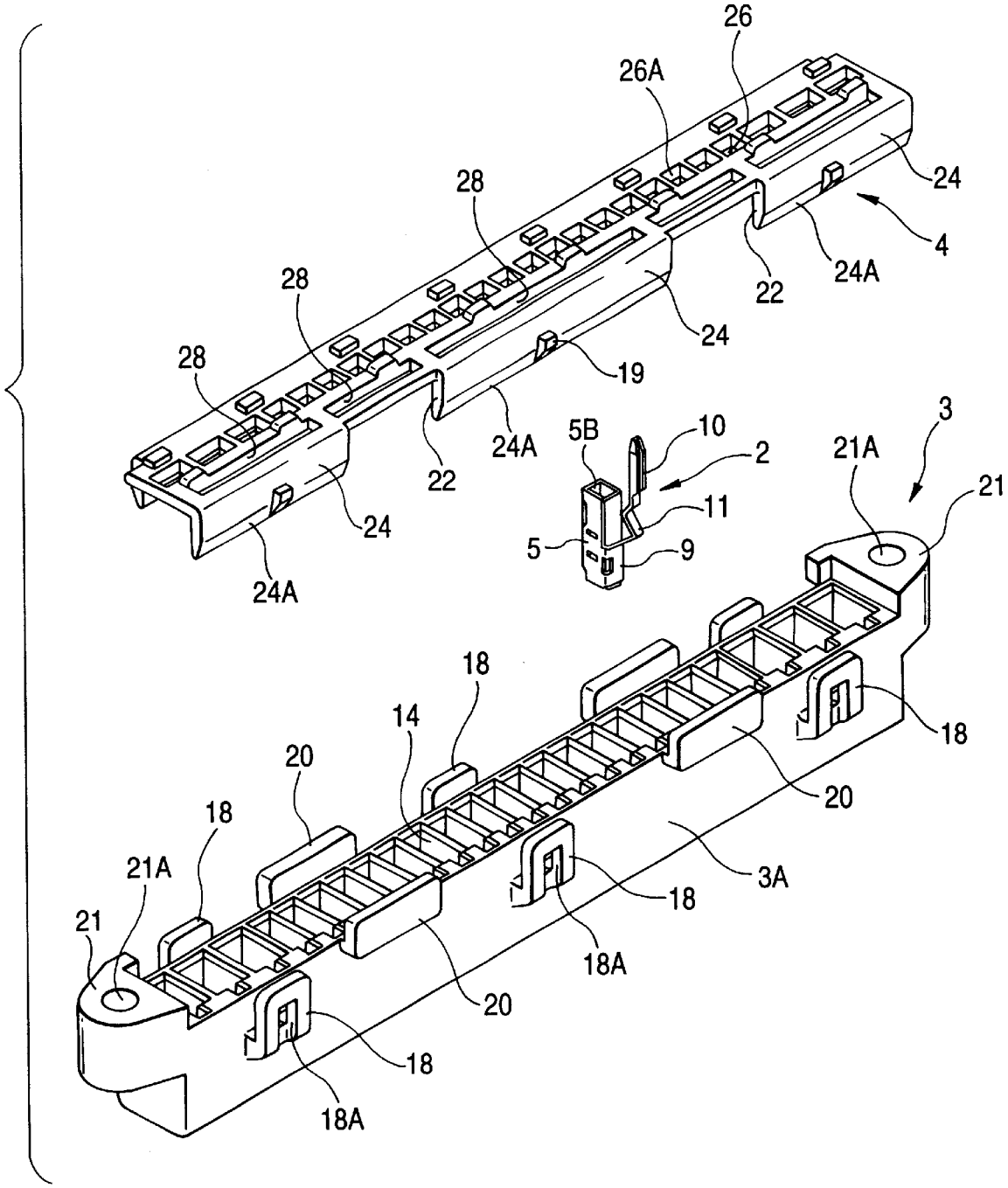
FIG. 1 is an exploded, perspective view of a preferred embodiment of a board-mounted-type connector of the present invention.

FIG. 1 shows a board-mounted-type connector 1, showing a condition before it is assembled. This board-mounted-type connector 1 comprises metal terminals 2, a housing body 3 (corresponding to an upper housing in the invention) for receiving the metal terminals 2 therein, and a retainer 4 (corresponding to a lower housing in the invention) for mounting on the housing body 3.

Figure 2:
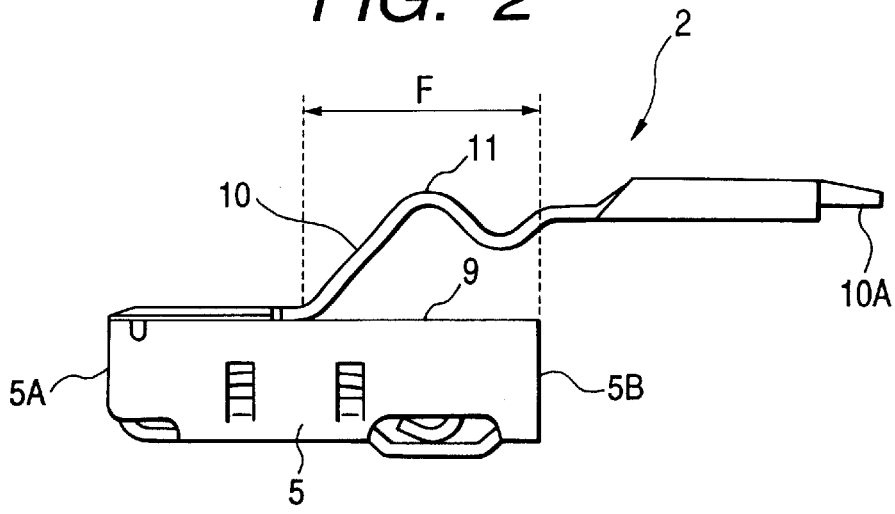
FIG. 2 is a front-elevational view of a metal terminal.
Figure 3:
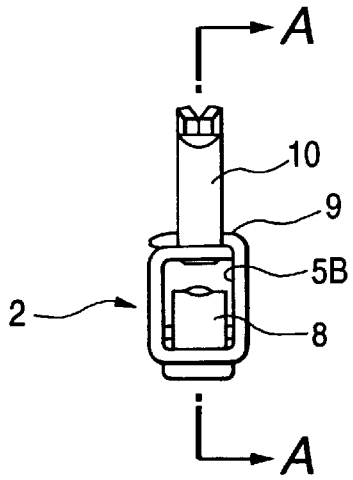
FIG. 3 is a plan view of the metal terminal.
Figure 4:
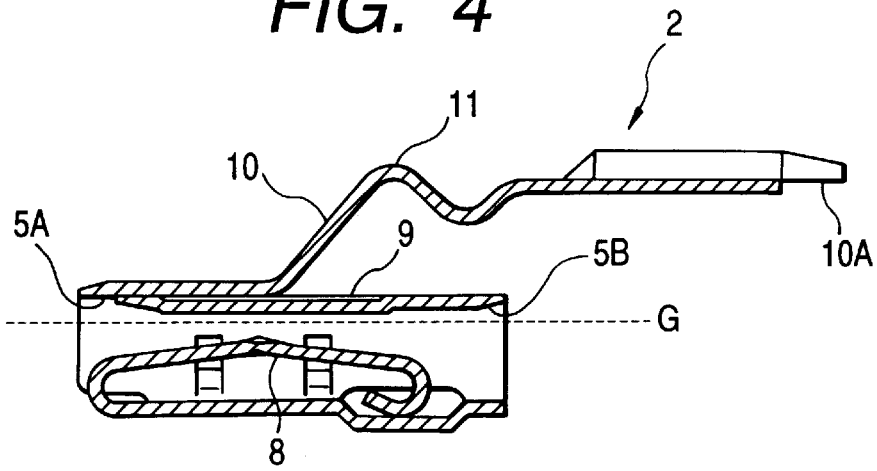
FIG. 4 is a cross-sectional view taken along the line A—A of FIG. 3.
Figure 5:
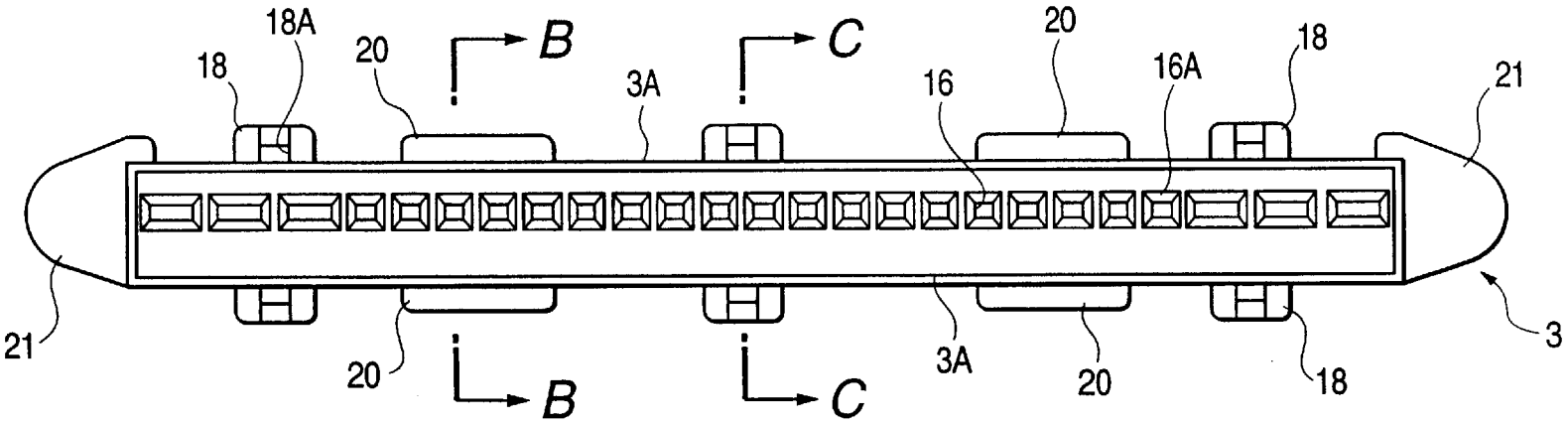
FIG. 5 is a plan view of a housing body.

As shown in FIGS. 2 to 4, the metal terminal 2 is formed by bending an electrically-conductive metal sheet, and includes a connecting portion 5 of a generally square tubular shape, and a board-fixing portion 10 extending from a generally-central portion of the connecting portion 5. In FIG. 2, opposite (right and left) ends of the connecting portion 5 are open, and define connecting ports 5A and 5B, respectively, and a mating metal terminal 7 can be inserted into the metal terminal 2 through either of the connecting ports 5A and 5B. (The left connecting port in FIG. 2 will hereinafter be referred to as "the upper connecting port 5A" while the right connecting port will hereinafter be referred to as "the lower connecting port 5B".) In FIG. 4, a resiliently-deformable press contact piece portion 8 is provided at a lower central portion of the interior of the connecting portion 5, and cooperates with an upper wall of the connecting portion 5 to hold the mating metal terminal 7 therebetween with a suitable pressure. The board-fixing portion 10 extends from a central portion of a side surface 9 (shown as an upper surface in FIG. 2) of the connecting portion 5. In FIG. 2, the board-fixing portion 10 is deflected (or offset) obliquely upwardly, and is bent into a generally S-shape, and then extends parallel to the axis of the connecting portion 5.

Thus, the connecting portion 5 and the board-fixing portion 10 overlap each other by a predetermined amount F (FIG. 2) in the direction of the length of the connecting portion 5. The overall length of the metal terminal 2 is shorter than that of the conventional metal terminals 120A and 120B by this overlapping amount F. That portion of the board-fixing portion 10, which is bent into a generally S-shape, defines a resilient flexing portion 11 which can be resiliently deformed with a suitable degree of resiliency. This resilient flexing portion 11 is resiliently deformable so as to prevent an excessive stress from developing in the other portion of the metal terminal 2. A distal end portion of the board-fixing portion 10, disposed forwardly of the resilient flexing portion 11, serves as an insertion end portion 10A to be inserted into a mounting hole 13 in a board 12. Opposite side portions of the insertion end portion 10A are bent generally at an angle of 90 degrees, and has a generally C-shaped cross-section.

As shown in FIGS. 5 to 8, the housing body 3 is molded into an integral construction, using a synthetic resin, and the metal terminals 2 can be received in the housing body 3. The housing body 3 is elongate as a whole, and can receive a row of metal terminals 2 therein. Cavities 14 for respectively receiving the metal terminals 2 are formed in the housing body 3 (More specifically, two kinds of cavities 14 are provided, and three large-size cavities are provided in each of the opposite (right and left) end portions of the housing body, and small-size cavities are arranged between the opposite-end large-size cavities. Naturally, there are used two kinds of metal terminals 2, and one kind of metal terminals are received respectively in the large-size cavities while the other kind of metal terminals are received respectively in the small-size cavities. The two kinds of cavities, as well as the two kinds of metal terminals, are not substantially different from each other, and therefore in this embodiment only one kind will be described.)

The size of the cavity 14 is determined in accordance with the length of the metal terminal 2 which is shorter in overall length than the conventional metal terminals 120A and 120B by the amount F, and therefore the cavity 14 can be made shallow, and hence the height (length in an upward-downward direction in FIG. 7) of the housing body 3 can be reduced. The interior of the cavity 14 is divided into a main chamber 14A for receiving the connecting portion 5 of the metal terminal 2 and an auxiliary chamber 14B which is disposed at the side of the main chamber 14A, and extends from a plane disposed generally centrally of the height of the main chamber 14A. The resilient flexing portion 11 of the board-fixing portion 10 is received in the auxiliary chamber 14B in sufficiently spaced relation to the inner surface of the auxiliary chamber 14B that the resilient flexing portion 11 can be resiliently deformed. A connecting hole 16 is formed in the inner end (shown as the upper end in FIG. 7) of the cavity 14, and is open to an upper surface 15 of the housing body 3. The mating metal terminal 7 can be inserted into the connecting hole 16. A guide surface 16A is formed at an outer edge of the connecting hole 16 so that the mating metal terminal 7 can be smoothly inserted into the connecting hole. The cavity 14 has a large lower open end serving as an insertion port 23 through which the metal terminal 2 can be inserted into the cavity.

Mounting projections 21 are formed respectively at the opposite (right and left) ends of the housing body 3, and extend downwardly from a plane disposed generally centrally of the height (FIG. 6) of the housing body 3. That portion of the lower side of the housing body 3, lying between the two mounting projections 21, is recessed upwardly to provide a retainer-mounting recess 17. A mounting hole or recess 21A is formed in a central portion of a lower surface of each of the mounting projections 21. Mounting pins (not shown), formed on the board 12, are fitted respectively in these mounting holes 21A, thereby fixing the board-mounted-type connector 1 to the board 12. Three engagement piece portions 18 are formed on each of the opposite sides (side surfaces) of the housing body (see FIG. 6) at predetermined intervals. The engagement piece portions 18 first project laterally from the side surface 3A of the housing body 3, and then extend downwardly in spaced relation to the side surface 3A. Each engagement piece portion 18 can be elastically deformed outwardly in the direction of the width (right-left direction in FIG. 7) of the housing body 3, and an engagement hole 18A is formed through a central portion of the engagement piece portion 18.

Figure 6:
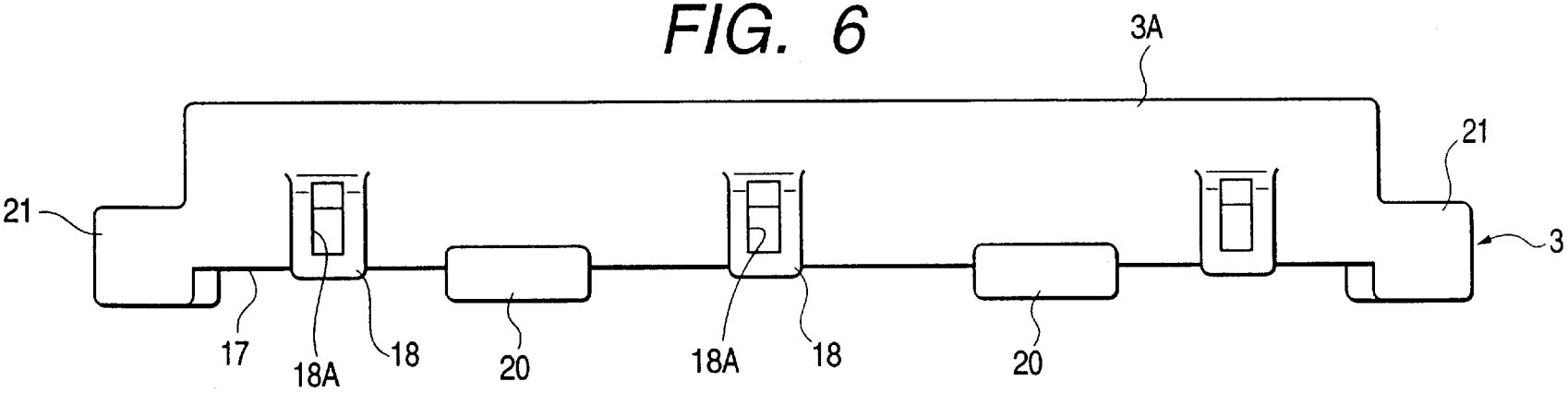
FIG. 6 is a front-elevational view of the housing body.
Figure 7:
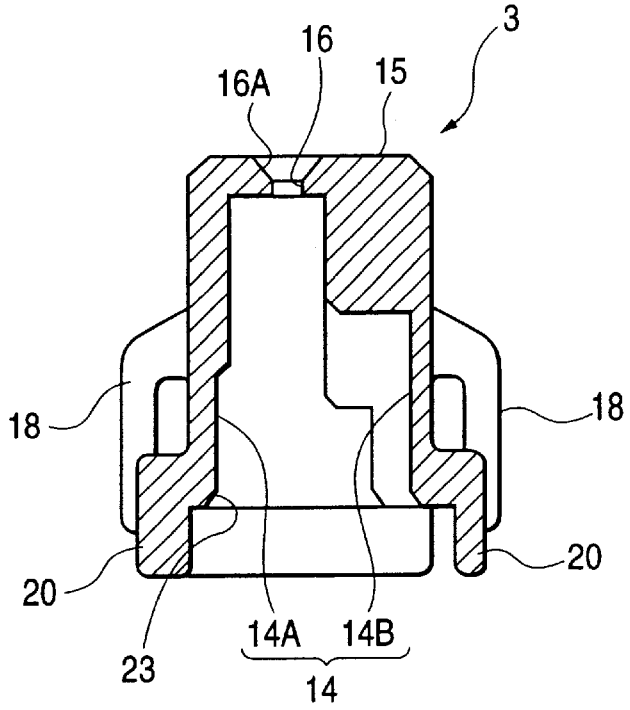
FIG. 7 is a cross-sectional view taken along the line B—B of FIG. 5.
Figure 8:
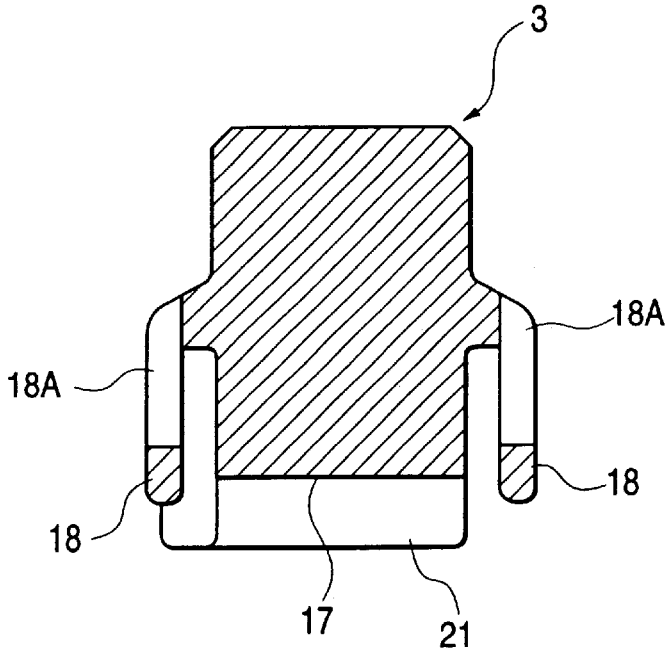
FIG. 8 is a cross-sectional view taken along the line C—C of FIG. 5.
Figure 9:
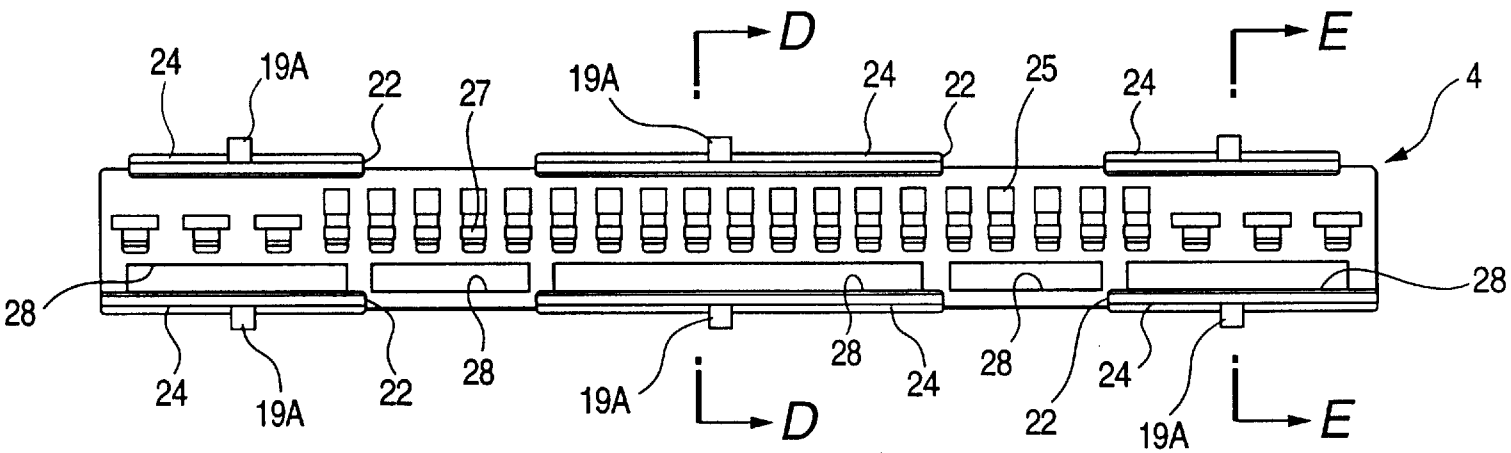
FIG. 9 is a plan view of a retainer.
Figure 10:
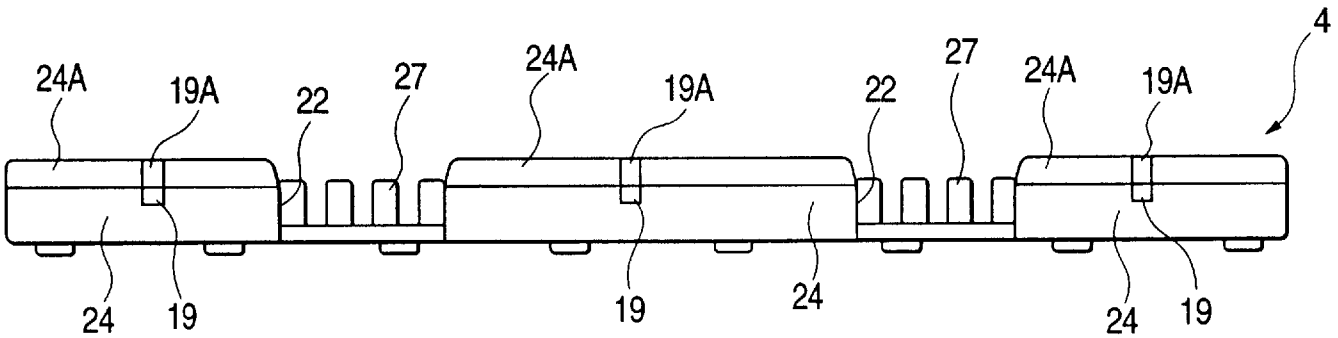
FIG. 10 is a front-elevational view of the retainer.
Figure 11:
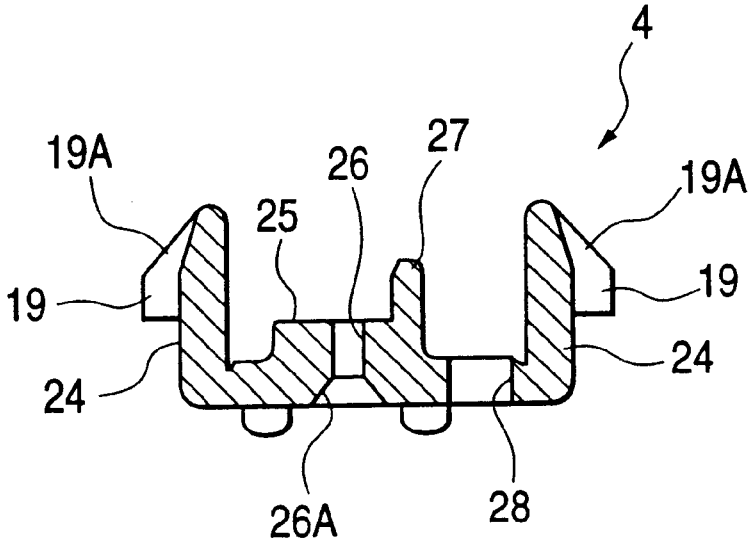
FIG. 11 i s a cross-sectional view taken along the line D—D of FIG. 9.
Figure 12:
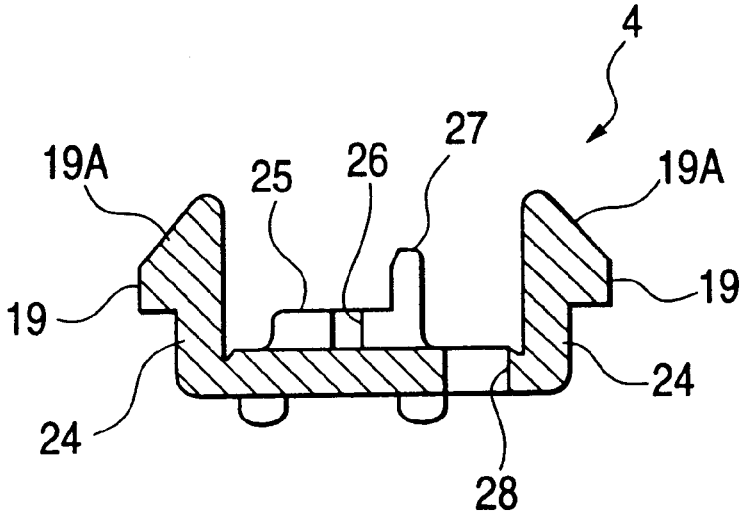
FIG. 12 is a cross-sectional view taken along the line E—E of FIG. 9.

Engagement projections 19, formed on the retainer 4, can be fitted in the engagement holes 18A, respectively, and the housing body 3 and the retainer 4 are held together against disengagement by this engagement. The engagement piece portions 18 are formed on the opposite sides of the housing body 3, and are disposed symmetrically with respect to the axis of the housing body 3 (see FIG. 7), and thus there are provided six engagement piece portions 18 in all. In FIG. 6, retainer holding piece portions 20 are formed on the front side of the housing body 3, and the retainer holding piece portion 20 is disposed between any two adjacent engagement piece portions 18. Each retainer holding piece portion 20 first projects laterally from the side surface 3A of the housing body 3, and then extends downwardly. The lower edge of each retainer holding piece portion 20 and the lower surface of each mounting projection 21 are disposed in a common plane. The retainer holding piece portions 20 can be fitted respectively in recesses 22 in the retainer 4.

Next, the retainer 4 will be described with reference to FIGS. 9 to 12. The retainer 4 is made of a synthetic resin, and can be mounted in the retainer-mounting recess 17 in the housing body 3. Those portions of opposite side walls 24 (shown as upper and lower walls in FIG. 9) of the retainer 4, corresponding respectively to the retainer holding piece portions 20 of the housing body 3, are notched to provide the recesses 22, respectively. The engagement projections 19, engageable respectively in the engagement holes 18A of the engagement piece portions 18 on the housing body 3, are formed on and project from the side walls 24. A guide surface 19A is formed on an upper surface of the engagement projection 19, and when the engagement projection 19 is to be fitted into the associated engagement hole 18A, the guide surface 19A elastically deforms the lower end of the engagement piece portion 18 outwardly so that this engagement operation can be effected smoothly. A guide surface 24A is formed on the upper edge of each of the opposite side walls 24 so that the retainer 4 can be smoothly connected to the housing body 3.

Means for preventing the withdrawal of the metal terminals 2 are provided at those portions of the upper side (that side shown in FIG. 9) of the retainer 4 corresponding respectively to the cavities 14 in the housing body 3. More specifically, those portions of this upper side, against which the edges of the lower connecting ports 5B of the connecting portions 5 can abut, respectively, are slightly raised to form abutment portions 25, respectively. A connecting hole 26 is formed through a generally central portion of the abutment portion 25, and the mating metal terminal 7 can be inserted into the connecting hole 26. A guide surface 26A is formed at a lower edge of the connecting hole 26 at the lower side of the retainer 4 so that the mating metal terminal 7 can be smoothly inserted into the connecting hole 26. A terminal-holding projection 27 is formed on and projects from a right edge portion (FIG. 11) of the abutment portion 25. This terminal-holding projection 27 holds the side surface 9 of the connecting portion 5 to position the metal terminal 2 and also to prevent the shaking of the metal terminal 2. Through holes 28 are formed vertically through that portion of the retainer 4 disposed on the right side (FIG. 11) of the abutment portions 25 in offset relation to the axes G (see FIGS. 4 and 16) of the connecting portions 5 of the metal terminals 2. Each through hole 28 is in the form of a slot extending in the direction of the length of the retainer 4, and the board-fixing portions 10 of a predetermined number of metal terminals 2 extend through the associated through hole 28. The provision of the slot-like through holes 28 allows the sliding displacement of the board-fixing portions 10 of the metal terminals 2.

Next, the operation and effects of this embodiment of the above construction will be described.

First, the procedure of assembling the board-mounted-type connector 1 will be described. As shown in FIG. 1, the housing body 3 is held in a condition shown in FIG. 1, with the insertion ports 23 directed upwardly, and each metal terminal 2 is caused to drop into the associated cavity 14 by its own weight, with the insertion end portion 10A of the board-fixing portion 10 directed upwardly. Then, the retainer 4 is attached to the housing body 3 from the upper side. The board-fixing portions 10 of the corresponding metal terminals 2 are passed through each through hole 28 in the retainer 4, and the retainer 4 is pressed against the housing body 3. As this assembling operation proceeds, the guide surface 19A of each engagement projection 19 on the retainer 4 slightly elastically deforms the associated engagement piece portion 18 of the housing body 3 outwardly. Then, the engagement projection 19 slides over the engagement piece portion 18, and is fitted into the engagement hole 18A, so that the engagement piece portion 18 is elastically restored, and therefore the housing body 3 and retainer 4 are held together against disengagement.

Figure 13:
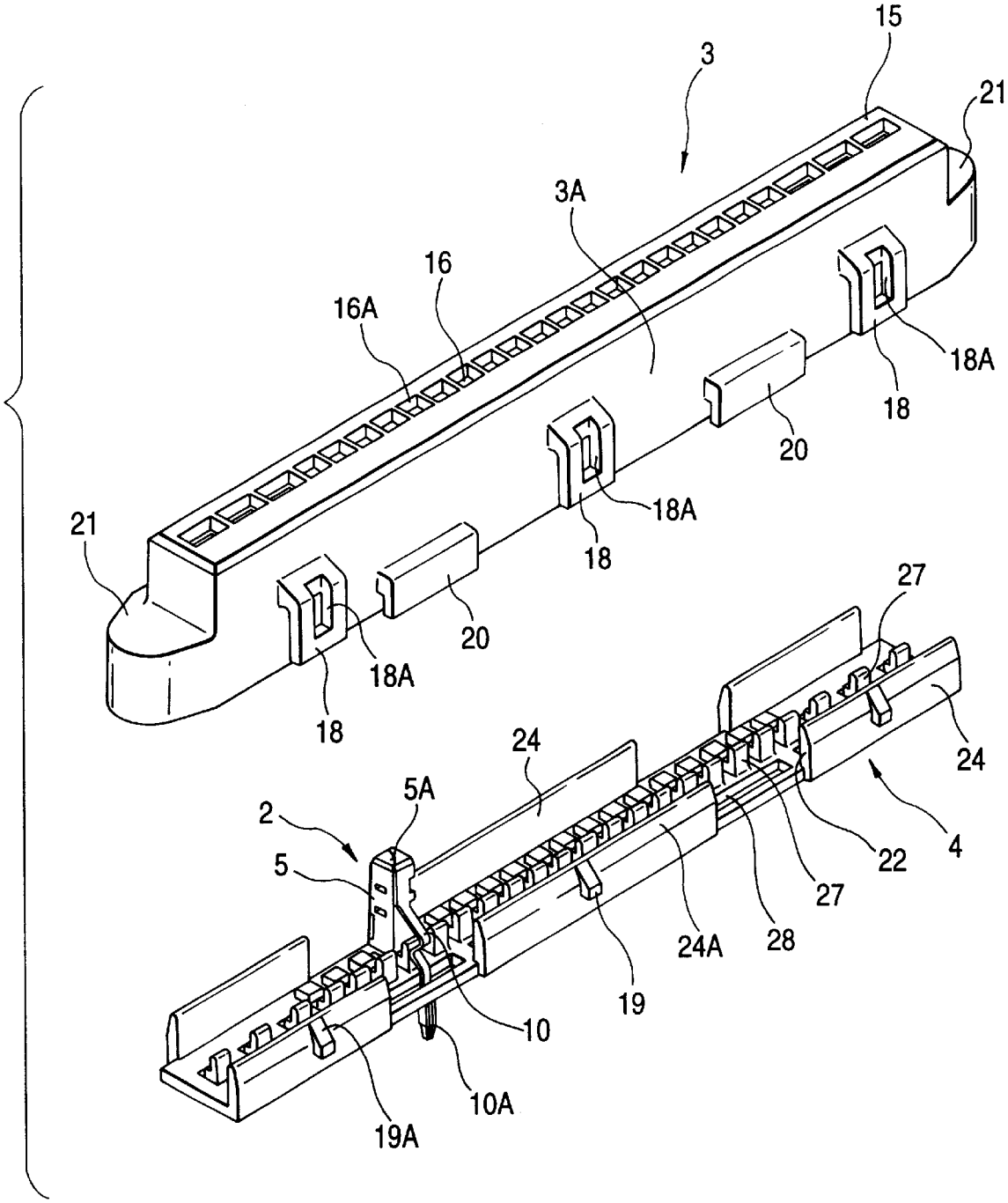
FIG. 13 is a perspective view showing a condition in which the housing body and the retainer, connected together to assemble the board-mounted-type connector, are separated from each other.
Figure 14:
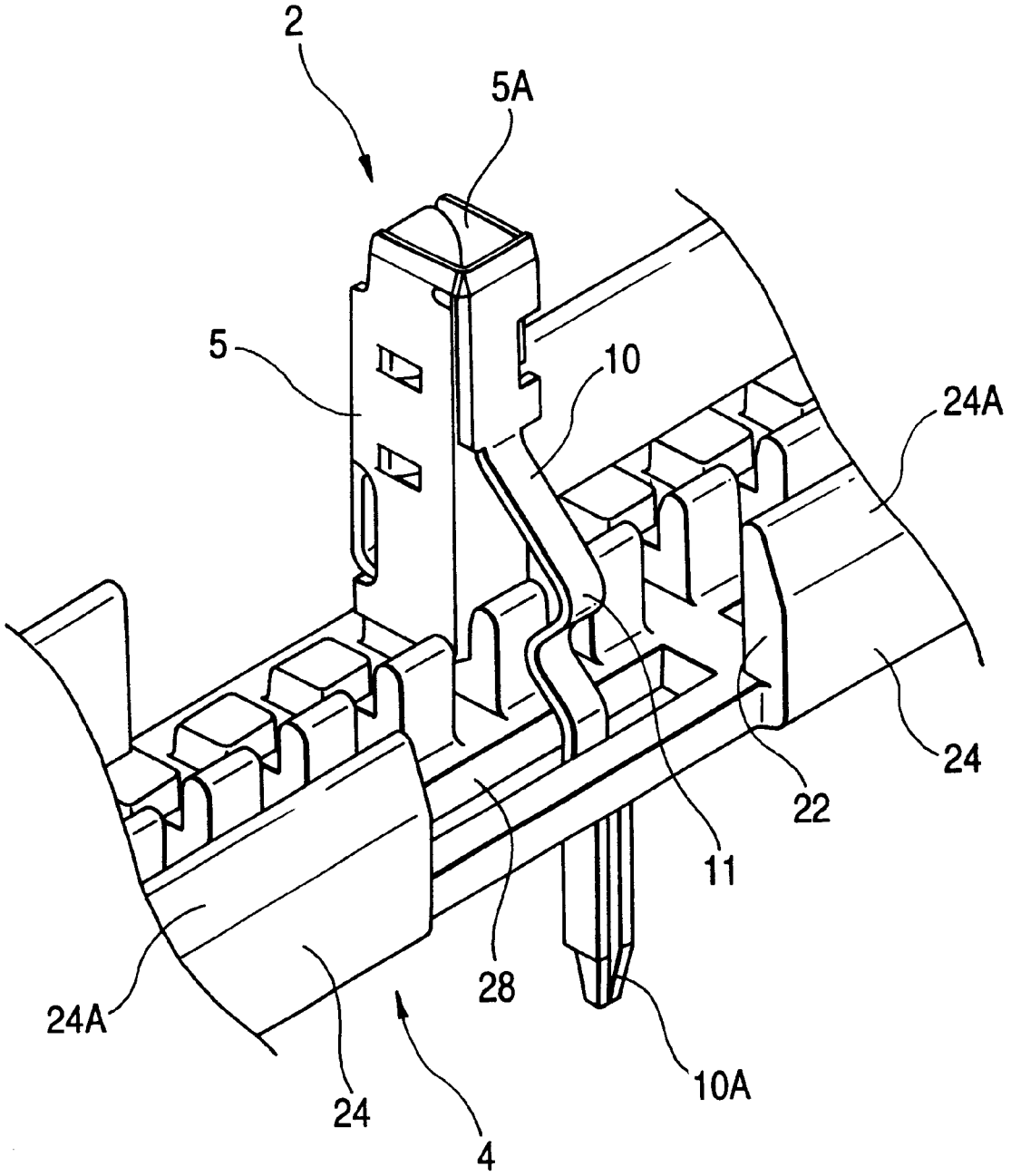
FIG. 14 is a perspective view showing the manner of mounting the metal terminal on the retainer.
Figure 15:
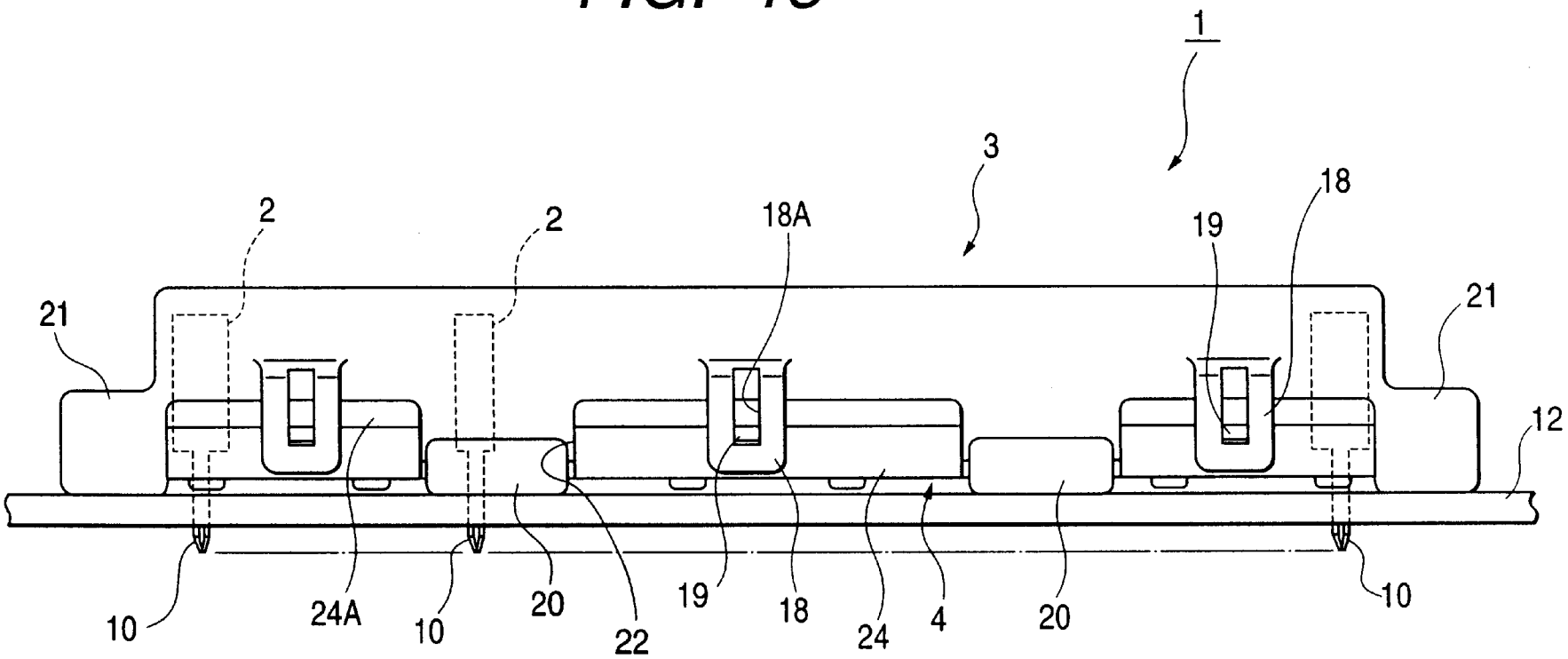
FIG. 15 is a front-elevational view of the board-mounted-type connector mounted on a board.

FIGS. 13 and 14 show a condition in which the housing body 3 and the retainer 4, thus connected together to assemble the board-mounted-type connector 1, are disengaged from each other. Each metal terminal 2 is retained against withdrawal in such a manner that the upper connecting port 5A is abutted against the inner end surface of the cavity 14 while the lower connecting port 5B is abutted against the abutment portion 25 of the retainer 4.

In this condition, although the board-fixing portion 10 extends vertically through the associated through hole 28, the board-fixing portion 10 can slide along the through hole 28 after the assembling operation is finished.

Then, the board-mounted-type connector 1 is mounted on the board 12. At this time, the board-mounted-type connector 1 is mounted on the board 12 in such a manner that the direction of extending of the through holes 28 in the retainer 4 coincides with a direction (corresponding to the direction of the length 10 of the board-mounted-type connector 1 in this embodiment) in which the board 12 is expected to be thermally expanded. The insertion end portion 10A of the board-fixing portion 10 of each metal terminal is inserted into the associated mounting hole 13 in the board 12, and then the metal terminal 2 is fixedly secured to the board 12 by solder 29 applied to the reverse surface (shown as the lower surface in FIG. 15) of the board 12 (The thus fixed portion corresponds to the fixed portion in the present invention).

Figure 16:
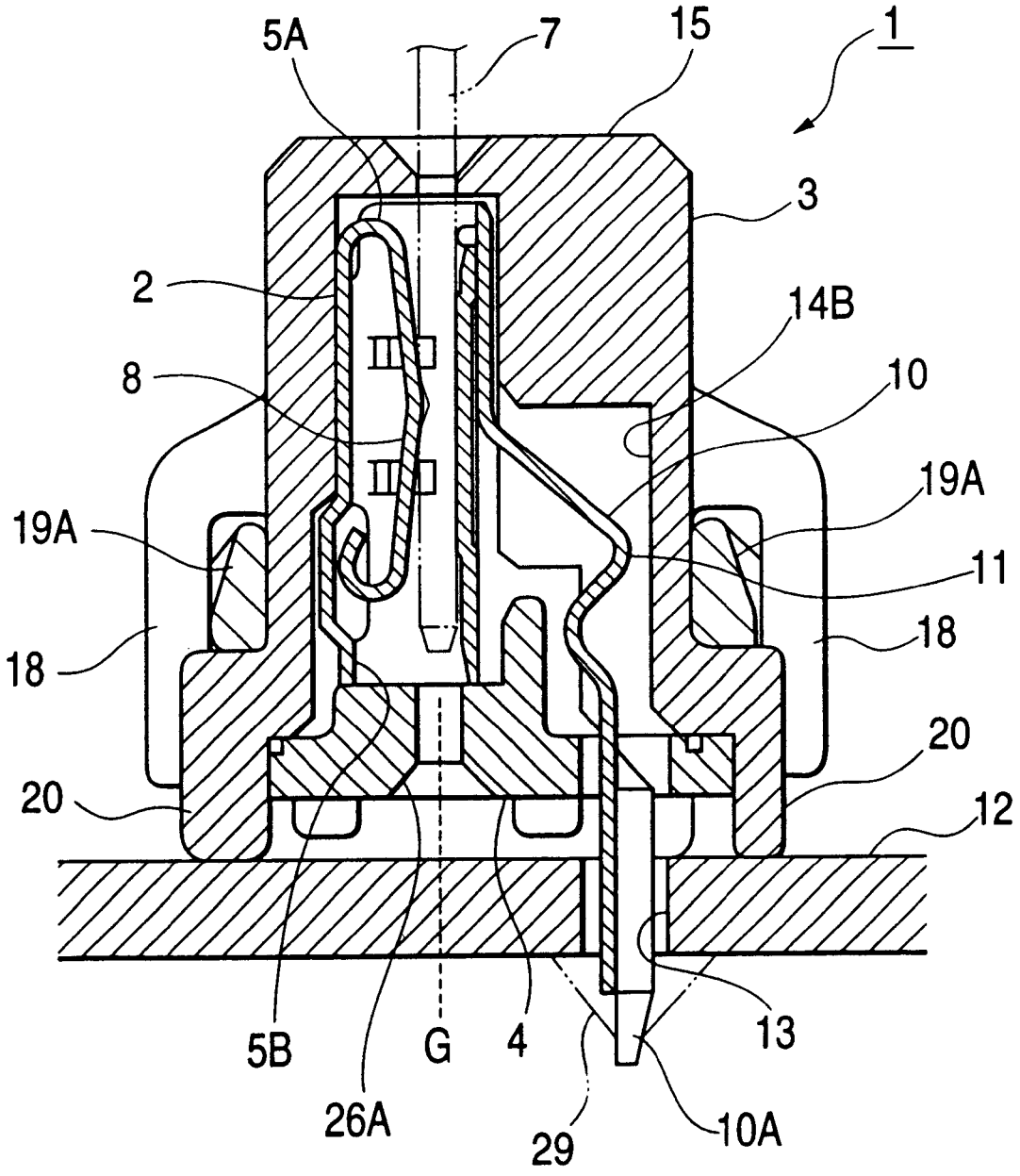
FIG. 16 is a cross-sectional view of the board-mounted-type connector mounted on the board, showing a condition in which a mating terminal is connected to the metal terminal from that side of the connector facing away from the board.
Figure 17:
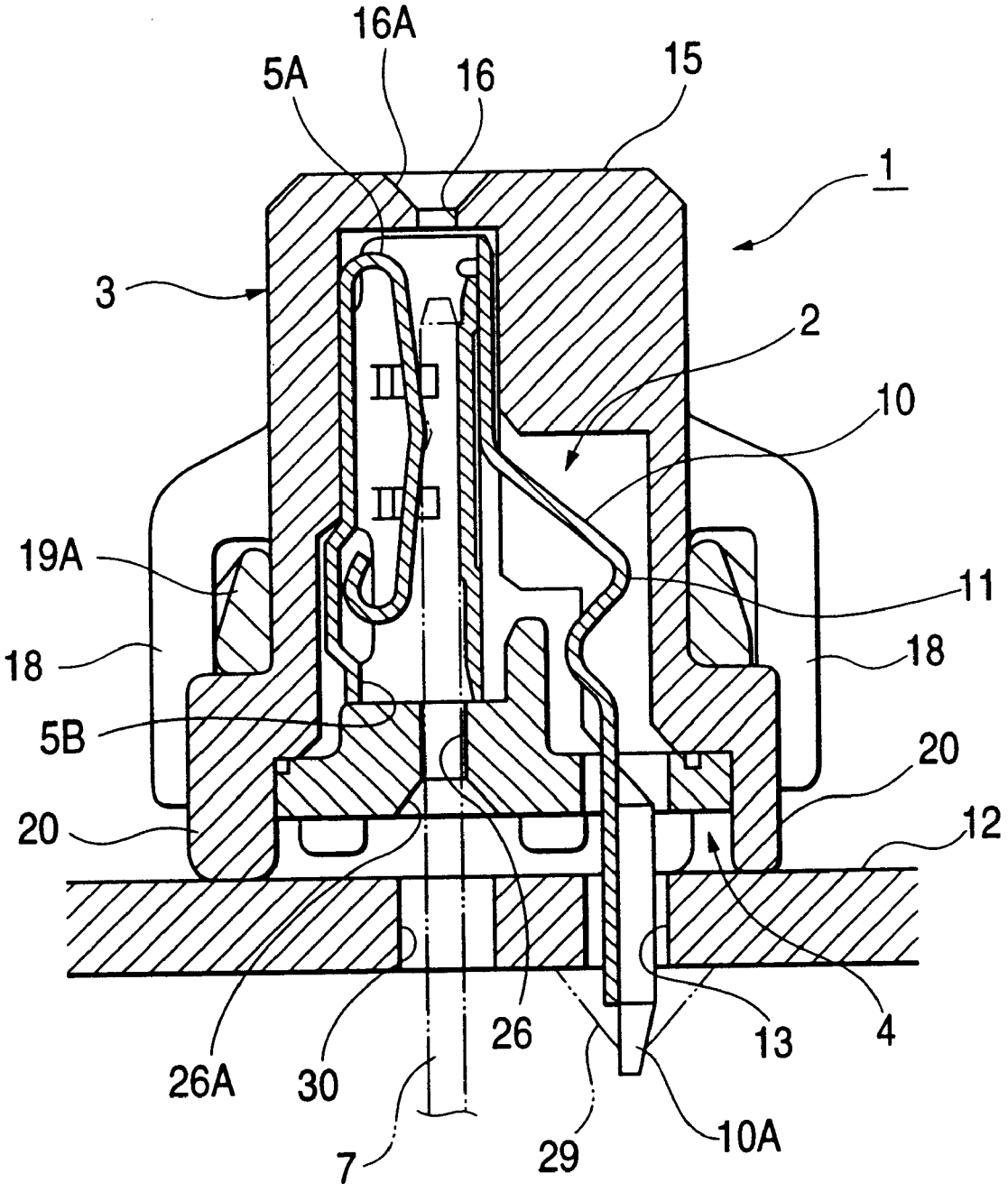
FIG. 17 is a cross-sectional view of the board-mounted-type connector mounted on the board, showing a condition in which the mating terminal is connected to the metal terminal from that side of the board facing away from the connector.
Figure 18:
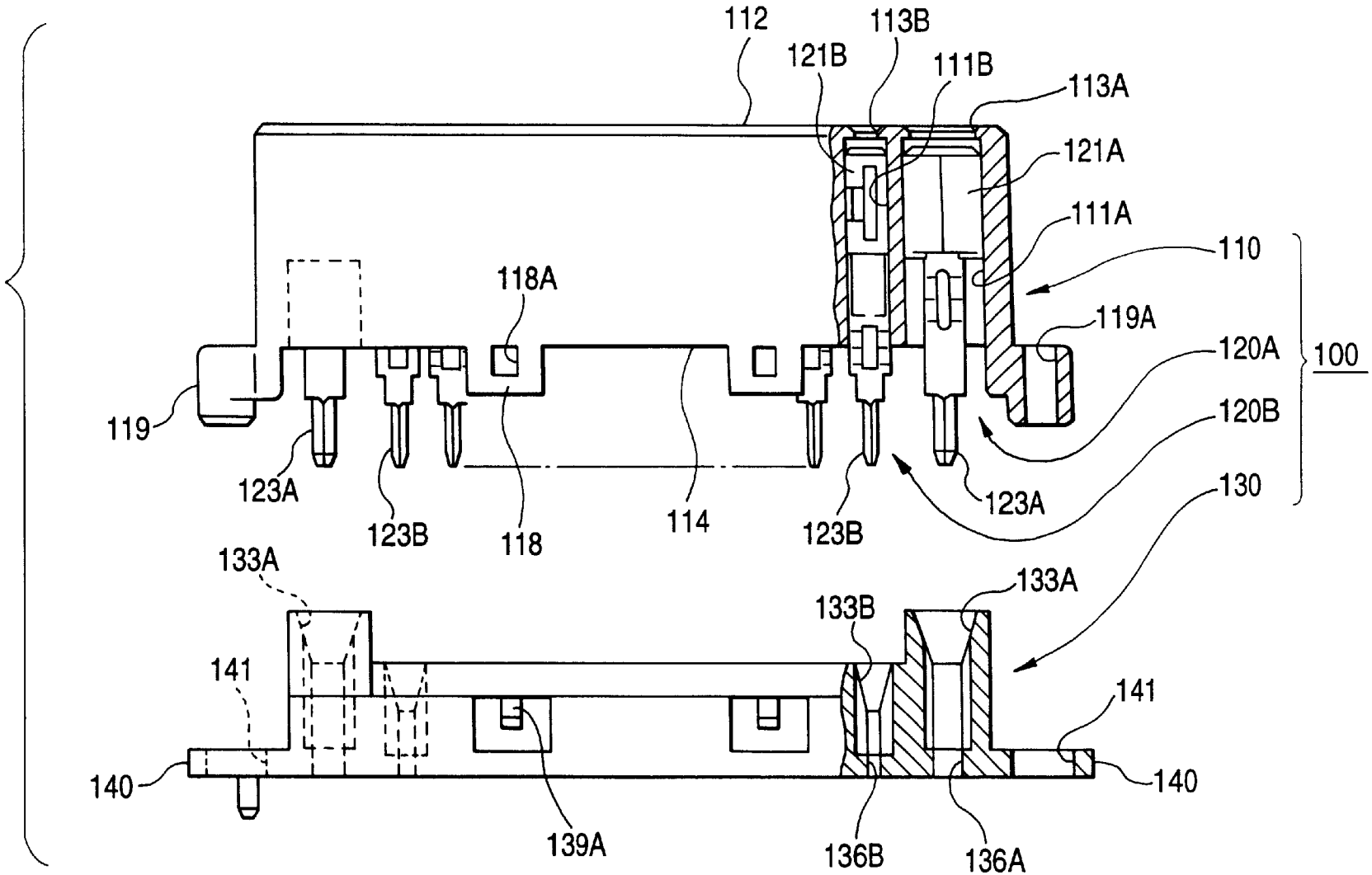
FIG. 18 is a partly-broken, exploded, front-elevational view of a conventional board-mounted-type connector.
Figure 19:
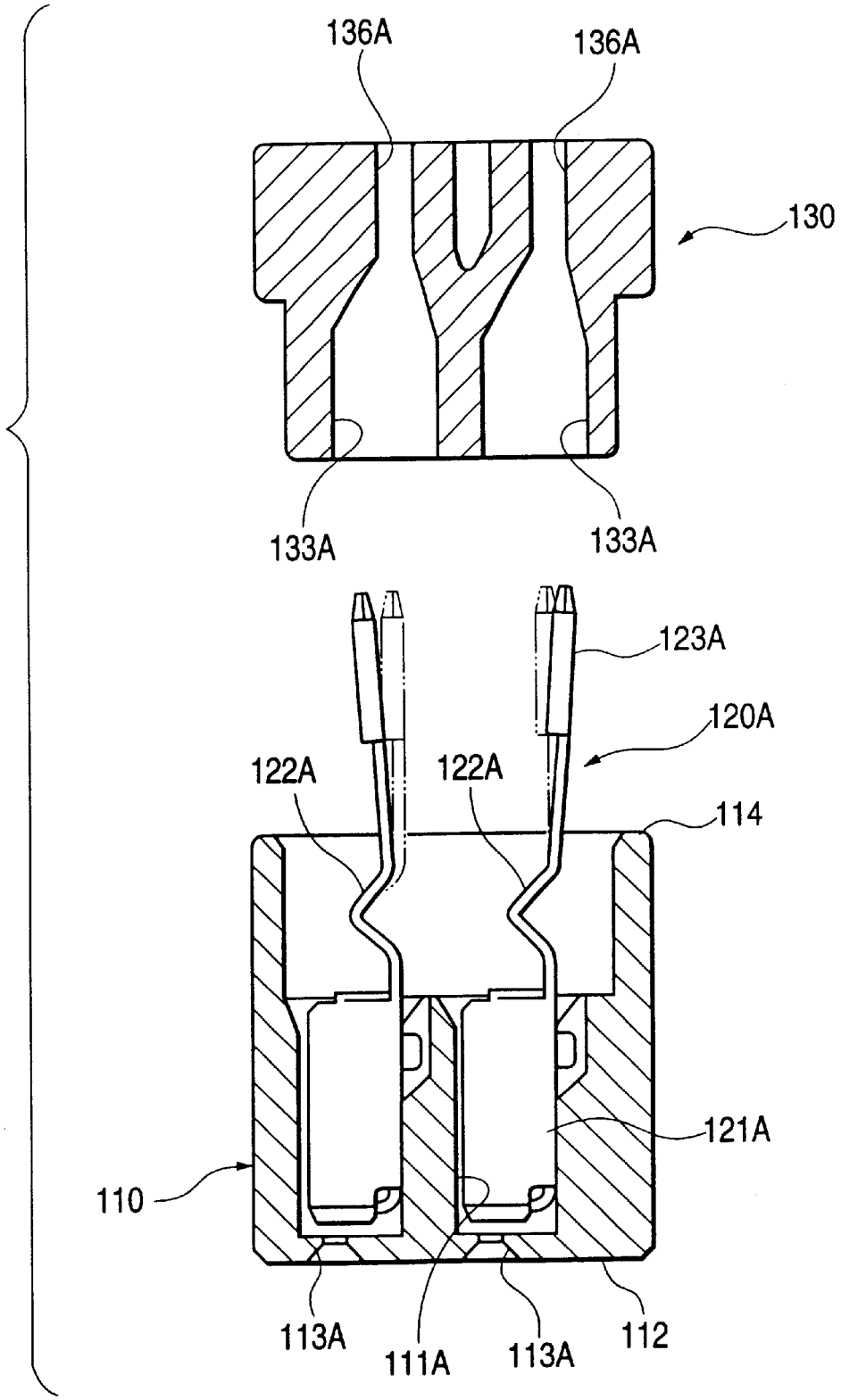
FIG. 19 is a cross-sectional view showing a condition before the conventional board-mounted-type connector is assembled.
Figure 20:
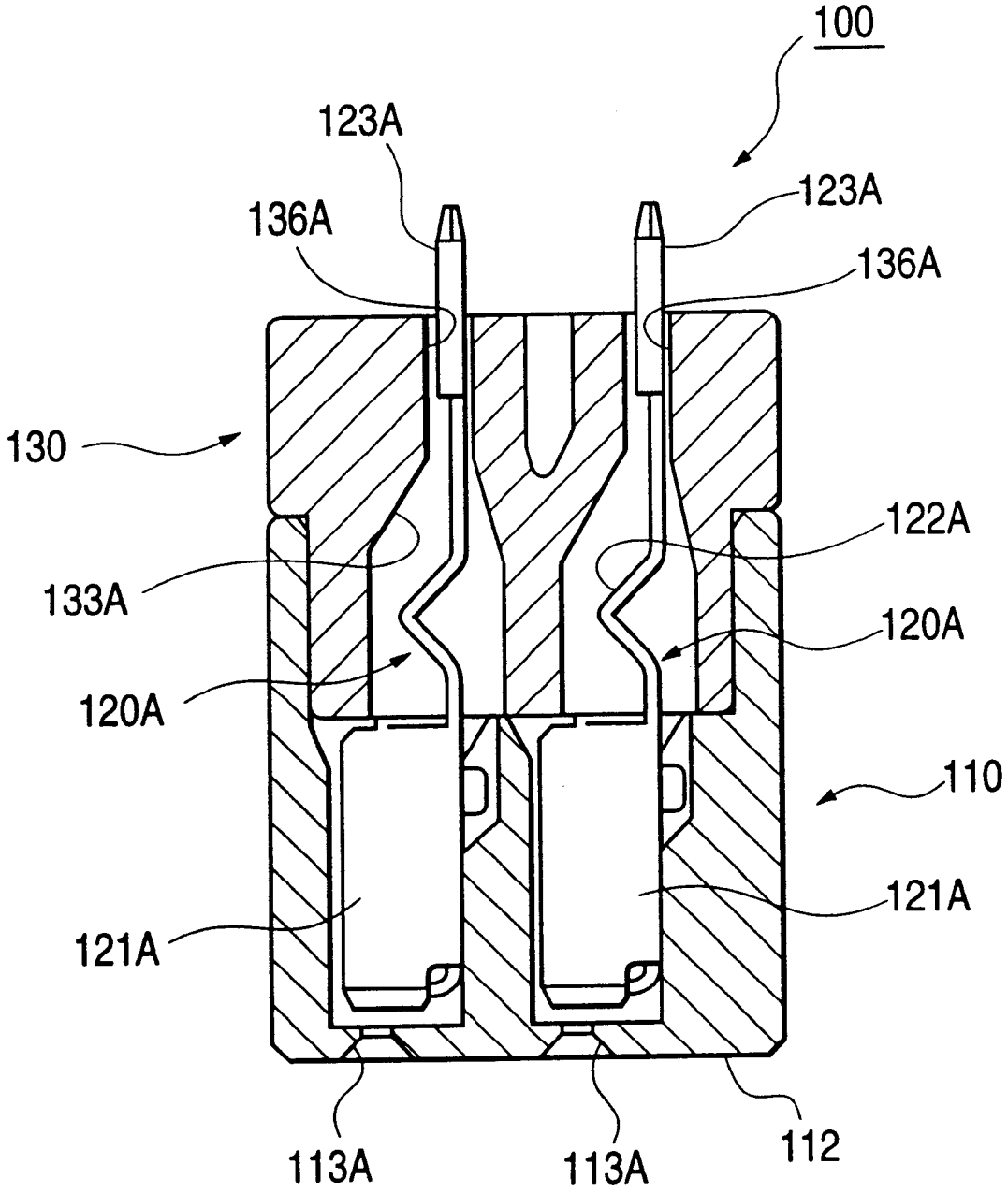
FIG. 20 is a cross-sectional view of the conventional board-mounted-type connector.
Figure 21:
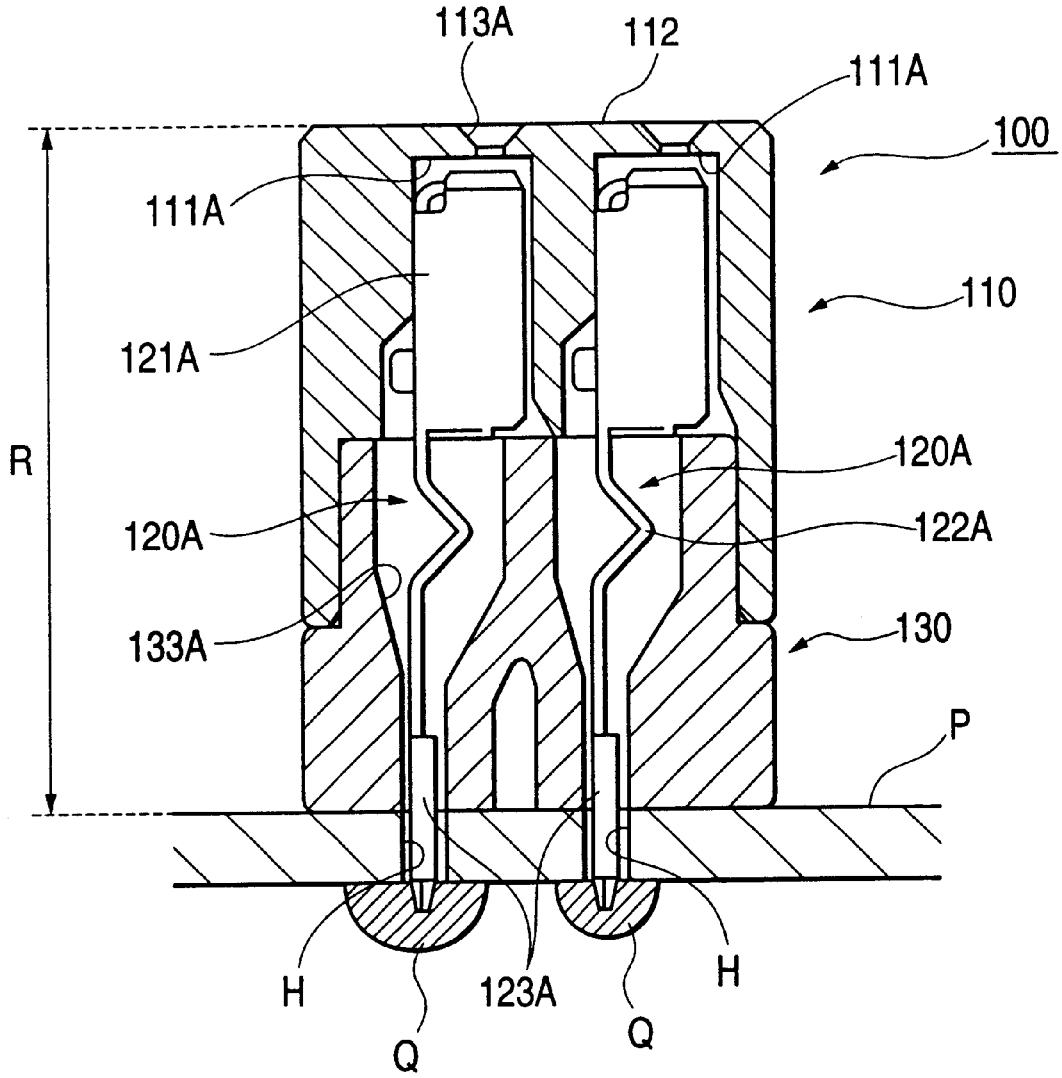
FIG. 21 is a cross-sectional view of the conventional board-mounted-type connector mounted on a board.

After the board-mounted-type connector 1 is thus fixed to the board 12, the mating metal terminals 7 are connected respectively to the metal terminals 2 mounted in the board-mounted-type connector 1. FIG. 16 shows a condition in which the mating metal terminal 7 is inserted into the metal terminal 2 from the upper side of the board-mounted-type connector 1, and is connected to the upper connecting port SA. FIG. 17 shows a condition in which the mating metal terminal 7 is inserted into the metal terminal 2 from the lower side of the board 2, and is connected to the lower connecting port 5B.

In this embodiment, the connecting portion 5 has the two connecting ports, that is, the upper connecting port 5A and the lower connecting port 5B, and therefore the mating metal terminal 7 can be connected to either of the opposite ends of the metal terminal 2 spaced from each other in the direction of the length of the metal terminal 2, and therefore the desired connecting direction can be selected.

The metal terminal 2 is of such a construction that the connecting portion 5 and the board-fixing portion 10 overlap each other by the predetermined amount F in the direction of the length thereof, and therefore the overall length of the metal terminal 2 can be reduced. Therefore, the dimension of the board-mounted-type connector 1 (which receives the metal terminals 2) in the direction (the upward-downward direction in FIG. 16) of the length of the metal terminal can be reduced. Therefore, even when there is exerted a force tending to displace the pair of female and male metal terminals 2 and 7, connected together (as shown in FIG. 16), with respect to each other, the solder 29, fixing the board-fixing portion 10 to the board 12, is prevented from being destroyed since the distance between the board-fixing portion 10 and the force-applied point is reduced.

And besides, each mating metal terminal 7 can be connected to the metal terminal 2 from the lower side of the board 12. (The board 12 has terminal-loosely-fitting holes 30 to be aligned respectively with the connecting holes 26 in the retainer 4. The mating metal terminal 7 extends through the terminal-loosely-fitting hole 30 in such a manner that the mating metal terminal 7 is held out of contact with the board 12.) Therefore, the board 12 and the mating metal terminals 7 vibrate generally in the same manner, and therefore each pair of metal terminals 2 and 7 are less liable to be displaced with respect to each other. Therefore, the solder 29, fixing the board-fixing portion 10 to the board 12, is less liable to undergo a force tending to destroy the solder 29.

And besides, the slot-like through holes 28 extends in the direction coinciding to the direction of thermal expansion of the board 12, and therefore each board-fixing portion 10 is allowed to displace in the direction of extending of the through hole 28 when the board 12 is thermally expanded, and therefore an undue force will not act on the fixed portion fixing the board-fixing portion 10 to the board 12.

The present invention is not limited to the above embodiment, and for example, the following also falls within the scope of the present invention.

(1) In the above embodiment, although the female metal terminals are mounted in the board-mounted-type connector, male metal terminals may be mounted in the connector of the invention.

(2) In the above embodiment, the cavities for respectively receiving the metal terminals are formed in the housing body (upper housing), and these cavities are covered with the retainer (lower housing). In the present invention, however, there maybe used a construction in which cavities for respectively receiving the metal terminals are formed in a lower housing, and are covered with an upper housing. In another modification, upper and lower cavity portions are formed respectively in upper and lower housings, and when the two housings are connected together, the complete cavities are formed.

What is claimed is:

1. A metal terminal for being received in a board-mounted-type connector to be mounted on a board comprising:

a connecting portion for electrical connection to a mating metal terminal, and a board-fixing portion which is connected at one end thereof to said connecting portion, and has the other end defining a board-insertion portion for insertion into a mounting hole formed in said board, wherein said board-fixing portion has first and second segments, the first segment being offset laterally from a side surface of said connecting portion, and the second segment has a surface contacting the side surface and overlaps the side surface of said connecting portion by a predetermined amount in a direction of a length of said connecting portion.

2. The metal terminal according to claim 1, wherein said connecting portion is connected to said mating metal terminal from that side of said board facing away from said board-mounted-type connector.

3. The metal terminal according to claim 1, wherein said connecting portion is connected to said mating metal terminal through either of the opposite ends of said connecting portion spaced from each other in a direction of the length of said metal terminal.

4. The board-mounted-type connector for receiving metal terminals according to claim 1, wherein said board-mounted-type connector comprises;

an upper housing, and a lower housing for mounting on said upper housing; and wherein a through hole for passing said board-fixing portions of said metal terminals therethrough is formed through said lower housing, and is offset from axes of said connecting portions of said metal terminals.

5. The board-mounted-type connector according to claim 4, wherein each mating metal terminal is connected to that end of the associated connecting portion opposed to said board, said lower housing has connection portions, and said board has connection portions, and each of said connection portions of said lower housing and each of said connection portions of said board are aligned with that end of the associated connecting portion opposed to said board so as to enable said mating metal terminal to be connected to said connecting portion.

6. The board-mounted-type connector according to claim 4, wherein said through hole is in the form of a slot, and extends generally in the same direction as a direction of thermal expansion of said board.

* * * * *